US010598028B2

(12) United States Patent
Hoskin et al.

(10) Patent No.: US 10,598,028 B2
(45) Date of Patent: Mar. 24, 2020

(54) EDGE COUPON INCLUDING COOLING CIRCUIT FOR AIRFOIL

(71) Applicant: General Electric Company, Schenectady, NY (US)

(72) Inventors: Robert Frank Hoskin, Duluth, GA (US); David Wayne Weber, Simpsonville, SC (US); Gregory Thomas Foster, Greer, SC (US)

(73) Assignee: General Electric Company, Schenectady, NY (US)

( * ) Notice: Subject to any disclaimer, the term of this patent is extended or adjusted under 35 U.S.C. 154(b) by 447 days.

(21) Appl. No.: 15/334,471

(22) Filed: Oct. 26, 2016

(65) Prior Publication Data

US 2018/0112540 A1 Apr. 26, 2018

(51) Int. Cl.
*F01D 5/18* (2006.01)
*F01D 5/14* (2006.01)

(52) U.S. Cl.
CPC ..... *F01D 5/187* (2013.01); *F01D 5/147* (2013.01); *F05D 2230/22* (2013.01); *F05D 2230/237* (2013.01); *F05D 2240/304* (2013.01); *F05D 2260/202* (2013.01)

(58) Field of Classification Search
CPC ..... F01D 5/147; F01D 5/186; F01D 5/187
See application file for complete search history.

(56) References Cited

U.S. PATENT DOCUMENTS 2,744,723 A 5/1956 Roush
3,220,697 A 11/1965 Smuland et al.
3,844,679 A 10/1974 Grondahl et al.
3,849,025 A 11/1974 Grondahl
4,021,139 A 5/1977 Franklin
4,302,153 A 11/1981 Tubbs
4,684,322 A 8/1987 Clifford et al.
4,761,116 A 8/1988 Braddy et al.
4,940,388 A 7/1990 Lilleker et al.
5,100,293 A 3/1992 Anzai et al.
5,236,309 A 8/1993 Van Heusden et al.
5,350,277 A 9/1994 Jacala et al.
5,464,322 A * 11/1995 Cunha ..... F01D 5/187 415/115

(Continued)

FOREIGN PATENT DOCUMENTS

EP 1533474 A2 5/2005
EP 1793085 A2 6/2007

OTHER PUBLICATIONS

U.S. Appl. No. 15/334,483, Office Action dated Jun. 28, 2018, 13 pages.

(Continued)

*Primary Examiner* — Brian P Wolcott
(74) *Attorney, Agent, or Firm* — Dale Davis; Hoffman Warnick LLC

(57) ABSTRACT

An edge coupon for an airfoil is provided. The coupon includes: a coupon body including: a coolant feed; an outward leg extending toward an edge of the coupon and fluidly coupled to the coolant feed; a return leg extending away from the edge of the coupon and radially offset from the outward leg along a radial axis of the coupon; a turn for fluidly coupling the outward leg and the return leg; a collection passage fluidly coupled to the return leg; and a coupling region configured to mate with an airfoil body of the airfoil.

21 Claims, 13 Drawing Sheets

(56) References Cited

U.S. PATENT DOCUMENTS

| | | | |
|---|---|---|---|
| 5,536,143 | A | 7/1996 | Jacala et al. |
| 5,915,923 | A | 6/1999 | Tomita et al. |
| 5,967,752 | A | 10/1999 | Lee et al. |
| 5,997,251 | A | 12/1999 | Lee |
| 6,099,252 | A | 8/2000 | Manning et al. |
| 6,227,804 | B1 | 5/2001 | Koga et al. |
| 6,247,896 | B1 | 6/2001 | Auxier et al. |
| 6,422,817 | B1 | 7/2002 | Jacala |
| 6,499,949 | B2 | 12/2002 | Schafrik et al. |
| 6,547,522 | B2 | 4/2003 | Turnquist et al. |
| 6,547,525 | B2 | 4/2003 | Haehnle et al. |
| 7,435,053 | B2 | 10/2008 | Liang |
| 7,530,789 | B1 | 5/2009 | Liang |
| 7,670,113 | B1 | 3/2010 | Liang |
| 7,717,675 | B1 | 5/2010 | Liang |
| 7,785,070 | B2 | 8/2010 | Liang |
| 7,845,906 | B2 | 12/2010 | Spangler et al. |
| 7,985,049 | B1 | 7/2011 | Liang |
| 8,047,788 | B1 | 11/2011 | Liang |
| 8,142,153 | B1 | 3/2012 | Liang |
| 8,317,472 | B1 | 11/2012 | Liang |
| 8,322,988 | B1 | 12/2012 | Downs et al. |
| 8,398,370 | B1 | 3/2013 | Liang |
| 8,444,386 | B1 | 5/2013 | Liang |
| 8,562,295 | B1 | 10/2013 | Liang |
| 8,608,430 | B1 | 12/2013 | Liang |
| 8,628,298 | B1 | 1/2014 | Liang |
| 8,678,766 | B1 | 3/2014 | Liang |
| 8,790,083 | B1 | 7/2014 | Liang |
| 8,864,469 | B1 | 10/2014 | Liang |
| 9,145,780 | B2 | 9/2015 | Propheter-Hinckley et al. |
| 9,447,692 | B1 | 9/2016 | Liang |
| 9,970,302 | B2 | 5/2018 | Lacy et al. |
| 2005/0058534 | A1 | 3/2005 | Lee et al. |
| 2009/0028702 | A1 | 1/2009 | Pietraszkiewicz et al. |
| 2009/0193657 | A1 | 8/2009 | Wilson, Jr. et al. |
| 2010/0303625 | A1 | 12/2010 | Kuhne et al. |
| 2013/0108471 | A1 | 5/2013 | Fujimoto |
| 2013/0272850 | A1 | 10/2013 | Bunker |
| 2014/0093379 | A1 | 4/2014 | Tibbott et al. |
| 2014/0127013 | A1 | 5/2014 | Spangler et al. |
| 2015/0041590 | A1 | 2/2015 | Kirtley et al. |
| 2015/0044059 | A1* | 2/2015 | Wassynger ..... F01D 5/005 416/97 R |
| 2015/0096305 | A1 | 4/2015 | Morgan et al. |
| 2015/0147164 | A1* | 5/2015 | Cui ..... F01D 5/188 415/175 |
| 2015/0252728 | A1 | 9/2015 | Veiga |
| 2015/0345303 | A1 | 12/2015 | Dong et al. |
| 2016/0169003 | A1 | 6/2016 | Wong et al. |
| 2016/0177741 | A1 | 6/2016 | Kirollos et al. |
| 2017/0234154 | A1 | 8/2017 | Downs |
| 2017/0350259 | A1 | 12/2017 | Dutta et al. |
| 2018/0230815 | A1 | 8/2018 | Jones |

OTHER PUBLICATIONS

U.S. Appl. No. 15/334,585, Office Action dated Jul. 31, 2018, 22 pages.
U.S. Appl. No. 15/334,517, Office Action dated Aug. 6, 2018, 24 pages.
U.S. Appl. No. 15/334,501, Office Action dated Aug. 10, 2018, 17 pages.
U.S. Appl. No. 15/334,450, Office Action dated Aug. 15, 2018, 49 pages.
U.S. Appl. No. 151334,474, Notice of Allowance dated Apr. 17, 2019, 16 pgs.
U.S. Appl. No. 15/334,448, Office Action dated May 14, 2019, 8 pages.
EP Search Report for corresponding European Patent Application No. 17198212 dated May 9, 2018, 7 pages.
U.S. Appl. No. 15/334,585 Notice of Allowance dated Jun. 7, 2019, 21 pgs.
U.S. Appl. No. 15/334,448, Notice of Allowance dated Jun. 19, 2019, 13 pages.
U.S. Appl. No. 15/334,483, Notice of Allowance dated Jun. 20, 2019, 8 pages.
U.S. Appl. No. 15/334,563, Office Action dated Dec. 12, 2018, 18 pages.
U.S. Appl. No. 15/334,474, Office Action dated Dec. 31, 2018, 13 pages.
U.S. Appl. No. 15/334,450, Notice of Allowance dated Jan. 10, 2019, 12 pages.
U.S. Appl. No. 15/334,501, Notice of Allowance dated Jan. 17, 2019, 11 pages.
U.S. Appl. No. 15/334,454, Notice of Allowance dated Jan. 24, 2019, 23 pages.
U.S. Appl. No. 15/334,585, Final Office Action dated Feb. 8, 2019, 20 pages.
U.S. Appl. No. 15/334,517, Notice of Allowance dated Mar. 20, 2019, 9 pgs.
U.S. Appl. No. 15/334,563, Notice of Allowance dated Apr. 9, 2019, 8 pgs.

* cited by examiner

EDGE COUPON INCLUDING COOLING CIRCUIT FOR AIRFOIL

This application is related to co-pending U.S. application Ser. Nos. 15/334,474, 15/334,454, 15/334,563, 15/334,585, 15/334,448, 15/334,501, 15/334,517, 15/334,450, and 15/334,483, all filed on Oct. 26, 2016.

BACKGROUND OF THE INVENTION

The disclosure relates generally to turbine systems, and more particularly, to cooling circuits for an airfoil.

Gas turbine systems are one example of turbomachines widely utilized in fields such as power generation. A conventional gas turbine system includes a compressor section, a combustor section, and a turbine section. During operation of a gas turbine system, various components in the system, such as turbine blades and nozzle airfoils, are subjected to high temperature flows, which can cause the components to fail. Since higher temperature flows generally result in increased performance, efficiency, and power output of a gas turbine system, it is advantageous to cool the components that are subjected to high temperature flows to allow the gas turbine system to operate at increased temperatures.

A blade typically contains an intricate maze of internal cooling passages. Coolant provided by, for example, a compressor of a gas turbine system, may be passed through and out of the cooling passages to cool various portions of the blade. Cooling circuits formed by one or more cooling passages in a blade may include, for example, internal near wall cooling circuits, internal central cooling circuits, tip cooling circuits, and cooling circuits adjacent the leading and trailing edges of the blade.

BRIEF DESCRIPTION OF THE INVENTION

A first aspect of the disclosure provides a trailing edge cooling system for a blade, including: a cooling circuit, including: an outward leg extending toward a trailing edge of the blade and fluidly coupled to a coolant feed; a return leg extending away from the trailing edge of the blade and fluidly coupled to a collection passage; and a turn for coupling the outward leg and the return leg; wherein the outward leg is radially offset from the return leg along a radial axis of the blade.

A second aspect of the disclosure provides a multi-wall turbine blade, including: a trailing edge cooling system disposed within the multi-wall turbine blade, the trailing edge cooling system including: a plurality of cooling circuits extending at least partially along a radial length of a trailing edge of the blade, each cooling circuit, including: an outward leg extending toward the trailing edge of the blade and fluidly coupled to a coolant feed; a return leg extending away from the trailing edge of the blade and fluidly coupled to a collection passage, and a turn for coupling the outward leg and the return leg; wherein the outward leg is radially offset from the return leg along a radial axis of the blade.

A third aspect of the disclosure provides turbomachine, including: a gas turbine system including a compressor component, a combustor component, and a turbine component, the turbine component including a plurality of turbine blades, at least one of the turbine blades including a blade; and a trailing edge cooling system disposed within the blade, the trailing edge cooling system including: a plurality of cooling circuits extending at least partially along a radial length of a trailing edge of the blade, each cooling circuit, including: an outward leg extending toward the trailing edge of the blade and fluidly coupled to a coolant feed; a return leg extending away from the trailing edge of the blade and fluidly coupled to a collection passage, and a turn for coupling the outward leg and the return leg; wherein the outward leg is radially offset from the return leg along a radial axis of the blade, and wherein the outward leg is laterally offset relative to the return leg.

A fourth aspect of the disclosure provides a trailing edge coupon for an airfoil, the coupon comprising: a coupon body including: a coolant feed; an outward leg extending toward a trailing edge of the coupon and fluidly coupled to the coolant feed; a return leg extending away from the trailing edge of the coupon and radially offset from the outward leg along a radial axis of the coupon; a turn for fluidly coupling the outward leg and the return leg; a collection passage fluidly coupled to the return leg; and a coupling region configured to mate with an airfoil body of the airfoil.

A fifth aspect of the disclosure a turbomachine airfoil, comprising: an airfoil body; a coupon having a coupon body including: a coolant feed; an outward leg extending toward a trailing edge of the coupon and fluidly coupled to the coolant feed; a return leg extending away from the trailing edge of the coupon and radially offset from the outward leg along a radial axis of the coupon; a turn for fluidly coupling the outward leg and the return leg; a collection passage fluidly coupled to the return leg; and a coupling region configured to mate with the airfoil.

A sixth aspect of the disclosure provides: a turbine system, comprising: a gas turbine system including a compressor component, a combustor component, and a turbine component, the turbine component including a plurality of turbine blades, at least one of the turbine blades including a blade including an airfoil body; and a coupon coupled to a trailing edge of the airfoil body, the coupon having a coupon body including: a coolant feed, an outward leg extending toward a trailing edge of the coupon and fluidly coupled to the coolant feed, a return leg extending away from the trailing edge of the coupon and radially offset from the outward leg along a radial axis of the coupon, a turn for fluidly coupling the outward leg and the return leg, a collection passage fluidly coupled to the return leg, and a coupling region configured to mate with the airfoil body of the airfoil.

A seventh aspect of the disclosure includes an edge coupon for an airfoil, the coupon comprising: a coupon body including: a coolant feed; an outward leg extending toward an edge of the coupon and fluidly coupled to the coolant feed; a return leg extending away from the edge of the coupon and radially offset from the outward leg along a radial axis of the coupon; a turn for fluidly coupling the outward leg and the return leg; a collection passage fluidly coupled to the return leg; and a coupling region configured to mate with an airfoil body of the airfoil.

The illustrative aspects of the present disclosure solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure.

Figure 1:
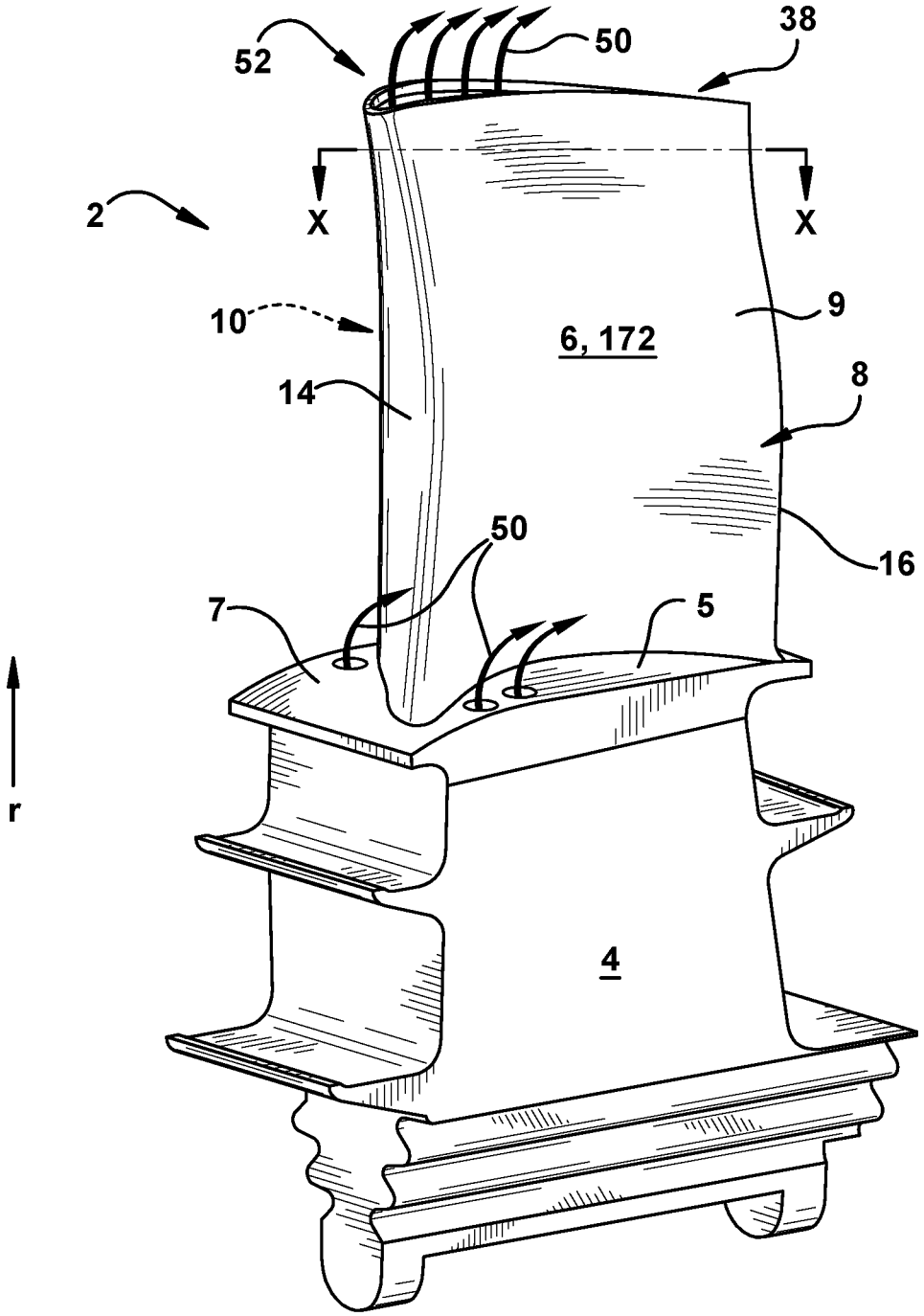
FIG. 1 is a perspective view of a blade according to various embodiments.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

As indicated above, the disclosure relates generally to turbine systems, and more particularly, to cooling circuits for an airfoil of a blade such as an airfoil of a multi-wall blade. A blade may include, for example, a turbine blade or a nozzle of a turbine system. In addition, the disclosure provides a coupon for a turbomachine airfoil.

According to embodiments, a trailing edge cooling circuit with flow reuse is provided for cooling an airfoil of a blade of a turbine system (e.g., a gas turbine system). A flow of coolant is reused after flowing through the trailing edge cooling circuit. After passing through the trailing edge cooling circuit, the flow of coolant may be collected and used to cool other sections of the airfoil of the blade. For example, the flow of coolant may be directed to at least one of the pressure or suction sides of the airfoil of the blade for convection and/or film cooling. Further, the flow of coolant may be provided to other cooling circuits within the blade, including tip, and platform cooling circuits.

Traditional trailing edge cooling circuits typically eject the flow of coolant out of an airfoil of a blade after it flows through a trailing edge cooling circuit. This is not an efficient use of the coolant, since the coolant may not have been used to its maximum heat capacity before being exhausted from the blade. Contrastingly, according to embodiments, a flow of coolant, after passing through a trailing edge cooling circuit, is used for further cooling of the blade. An additional embodiment of the disclosure provides a coupon for attachment to an airfoil for providing similar functionality where not provided internally.

In the Figures (see, e.g., FIG. 10), the "A" axis represents an axial orientation. As used herein, the terms "axial" and/or "axially" refer to the relative position/direction of objects along axis A, which is substantially parallel with the axis of rotation of the turbine system (in particular, the rotor section). As further used herein, the terms "radial" and/or "radially" refer to the relative position/direction of objects along an axis "r" (see, e.g., FIG. 1), which is substantially perpendicular with axis A and intersects axis A at only one location. Finally, the term "circumferential" refers to movement or position around axis A.

Turning to FIG. 1, a perspective view of a turbine blade 2 is shown. Turbine blade 2 includes a shank 4 and an airfoil 6 coupled to and extending radially outward from shank 4. Airfoil 6 includes an airfoil body 9 including a pressure side 8, an opposed suction side 10, and a tip area 52. Airfoil 6 further includes a leading edge 14 between pressure side 8 and suction side 10, as well as a trailing edge 16 between pressure side 8 and suction side 10 on a side opposing leading edge 14. Airfoil 6 extends radially away from a pressure side platform 5 and a suction side platform 7.

Shank 4 and airfoil 6 may each be formed of one or more metals (e.g., nickel, alloys of nickel, etc.) and may be formed (e.g., cast, forged or otherwise machined) according to conventional approaches. Shank 4 and airfoil 6 may be integrally formed (e.g., cast, forged, three-dimensionally printed, etc.), or may be formed as separate components which are subsequently joined (e.g., via welding, brazing, bonding or other coupling mechanism).

Figure 2A:
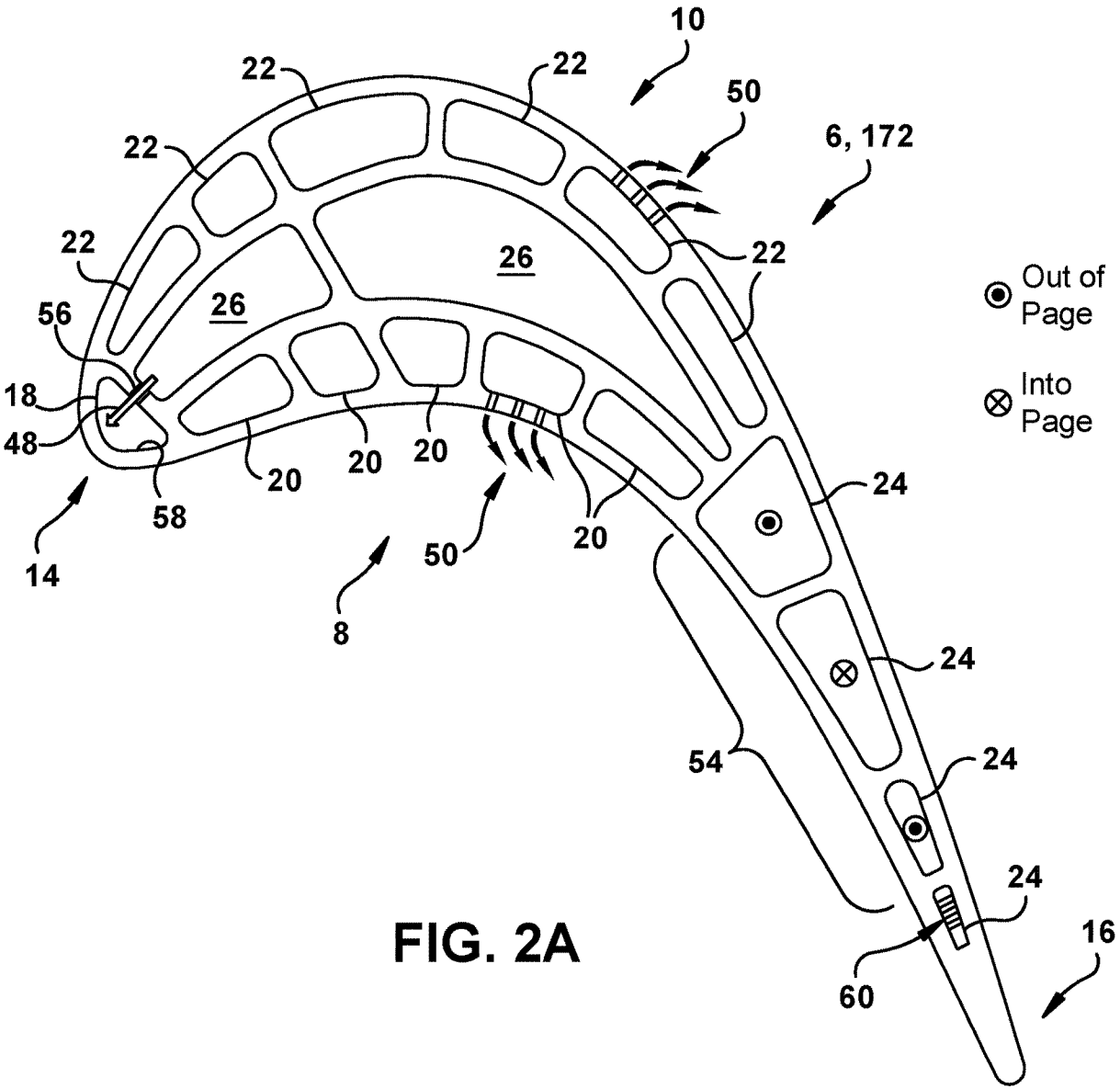
FIG. 2A is a cross-sectional view of the blade of FIG. 1, taken along line X-X in FIG. 1 according to various embodiments.
Figure 2B:
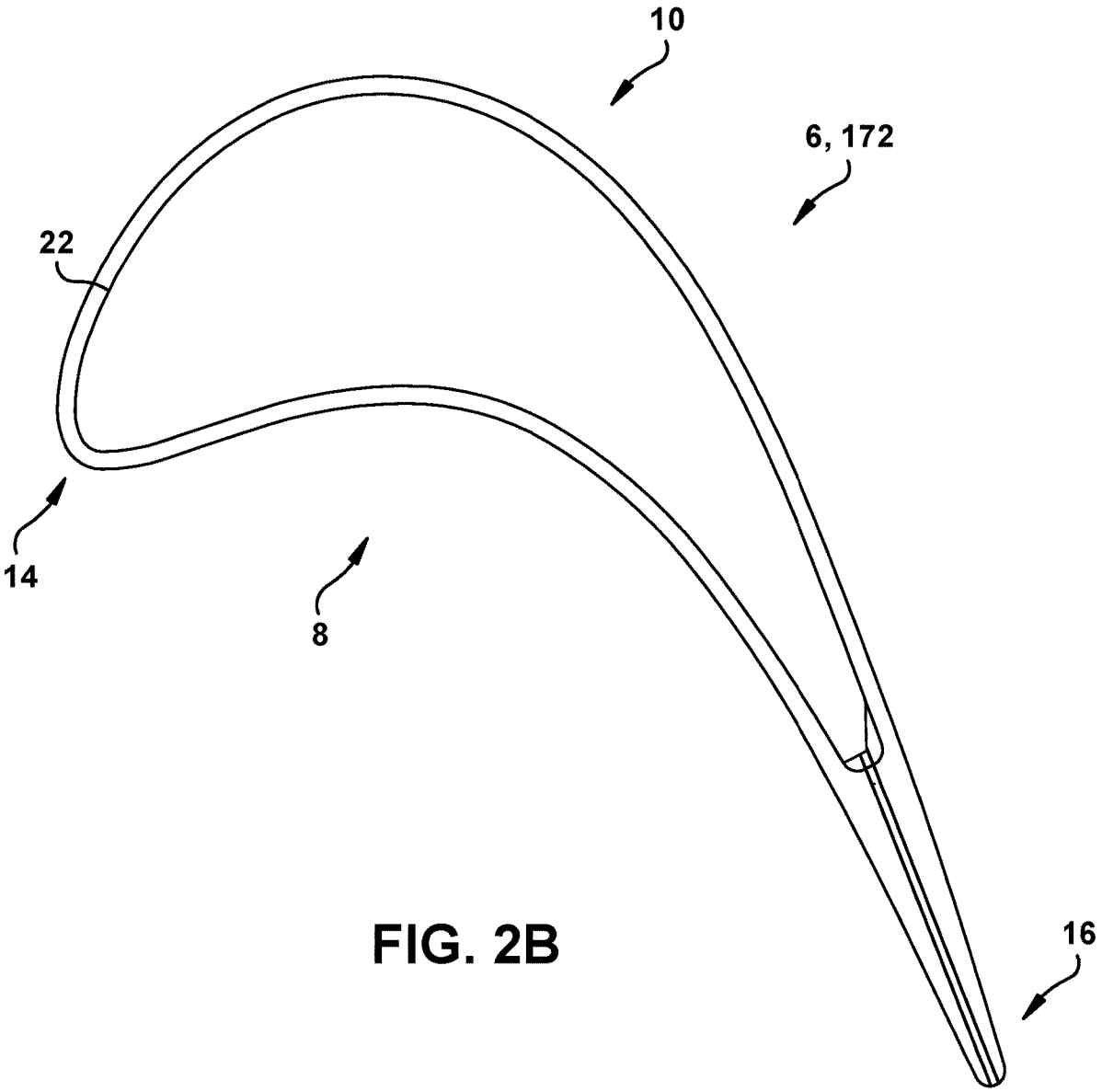
FIG. 2B is a cross-sectional view of the blade of FIG. 1, taken along line X-X in FIG. 1 according to various alternative embodiments.

FIGS. 2A and 2B depict a cross-sectional view of two illustrative embodiments of airfoil 6 taken along line X-X of FIG. 1. As shown in FIG. 2A, airfoil 6 may include a plurality of internal passages as part of a multi-wall blade. It is emphasized, however, that the teachings of the disclosure are equally applicable to airfoils and blades that are not multi-walled and do not include multiple internal passages, such as that shown in FIG. 2B. In embodiments, airfoil 6 includes at least one leading edge passage 18, at least one pressure side (near wall) passage 20, at least one suction side (near wall) passage 22, at least one trailing edge passage 24, and at least one central passage 26. The number of passages 18, 20, 22, 24, 26 within airfoil 6 may vary, of course, depending upon for example, the specific configuration, size, intended use, etc., of airfoil 6. To this extent, the number of passages 18, 20, 22, 24, 26 shown in the embodiments disclosed herein is not meant to be limiting. According to embodiments, various cooling circuits can be provided using different combinations of passages 18, 20, 22, 24, 26.

Figure 4:
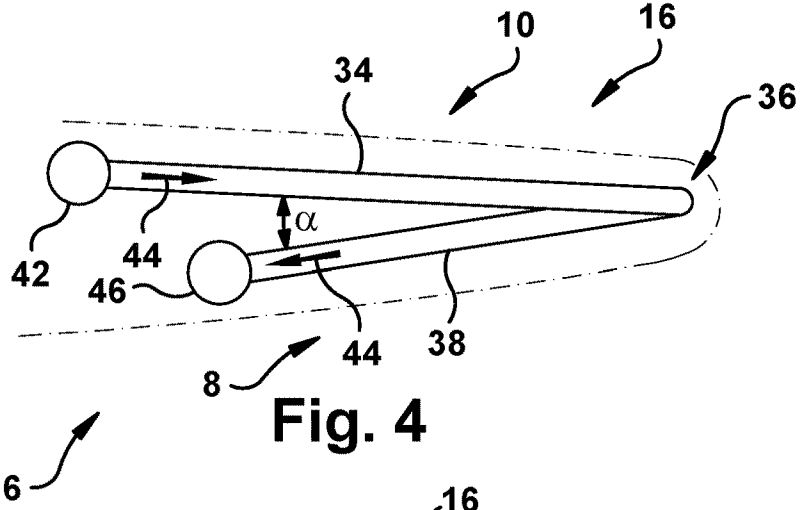
FIG. 4 is a top cross-sectional view of the trailing edge cooling circuit of FIG. 3 according to various embodiments.
Figure 5:
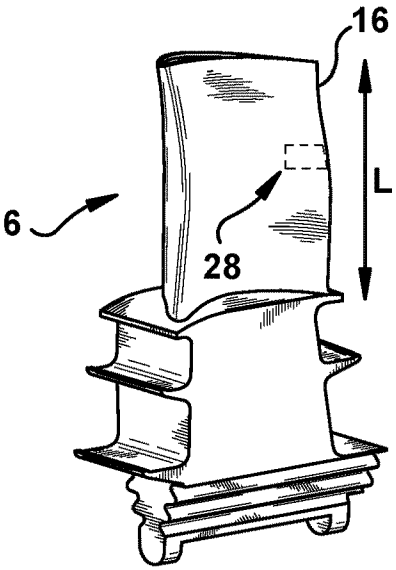
FIG. 5 is a perspective view depicting the section shown in FIGS. 3 and 4 of the blade of FIG. 1 according to various embodiments.
Figure 3:
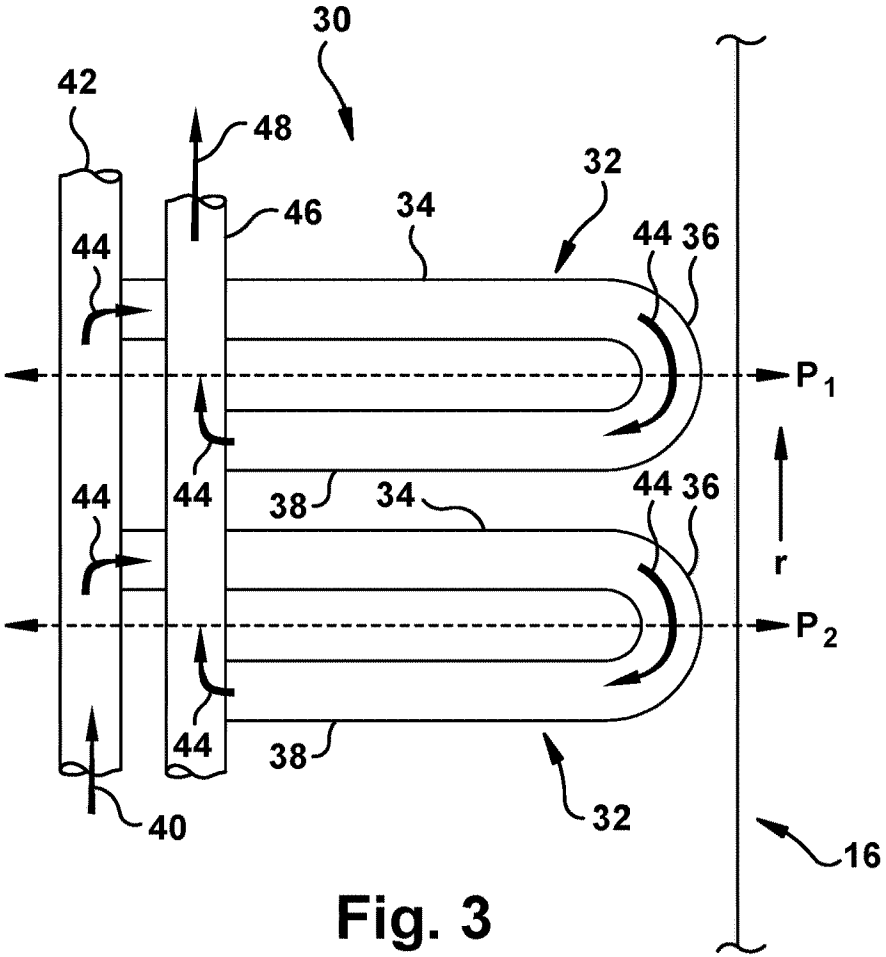
FIG. 3 is a side view of a portion of a trailing edge cooling circuit according to various embodiments.

An embodiment including a trailing edge cooling circuit 30 is depicted in FIGS. 3-5. As the name indicates, trailing edge cooling circuit 30 is located adjacent trailing edge 16 of airfoil 6, between pressure side 8 and suction side 10 of airfoil 6.

Trailing edge cooling circuit 30 includes a plurality of radially spaced (i.e., along the "r" axis (see, e.g., FIG. 1)) cooling circuits 32 (only two are shown), each including an outward leg 34, a turn 36, and a return leg 38. Outward leg 34 extends axially toward trailing edge 16 of airfoil 6. Return leg 38 extends axially toward leading edge 14 of airfoil 6. In embodiments, trailing edge cooling circuit 30 may extend along the entire radial length L (FIG. 5) of trailing edge 16 of airfoil 6. In other embodiments, trailing edge cooling circuit 30 may partially extend along one or more portions of trailing edge 16 of airfoil 6.

In each cooling circuit 32, outward leg 34 is radially offset along the "r" axis relative to return leg 38 by turn 36. To this extent, turn 36 fluidly couples outward leg 34 of cooling circuit 32, which is disposed at a first radial plane $P_1$, to return leg 38 of cooling circuit 32, which is disposed in a second radial plane $P_2$, different from the first radial plane $P_1$. In the non-limiting embodiment shown in FIG. 3, for example, outward leg 34 is positioned radially outward relative to return leg 36 in each of cooling circuits 32. In other embodiments, in one or more of cooling circuits 32, the radial positioning of outward leg 34 relative to return leg 38 may be reversed such that outward leg 34 is positioned radially inward relative to return leg 36. A non-limiting position 28 of the portion of trailing edge cooling circuit 30 depicted in FIG. 3 within airfoil 6 is illustrated in FIG. 5.

As shown in FIG. 4, in addition to a radial offset, outward leg 34 may be circumferentially offset by turn 36 at an angle $\alpha$ relative to return leg 38. In this configuration, outward leg 34 extends along suction side 10 of airfoil 6, while return leg 38 extends along pressure side 8 of airfoil 6. Each leg 34, 38 may follow the outer contours of their respective adjacent side 8 or 10. The radial and circumferential offsets may vary, for example, based on geometric and heat capacity constraints on trailing edge cooling circuit 30 and/or other factors. In other embodiments, outward leg 34 may extend along pressure side 8 of airfoil 6, while return leg 38 may extend along suction side 10 of airfoil 6. Each leg 34, 38 may follow the outer contours of their respective adjacent side 8 or 10.

A flow of coolant 40, for example, air generated by a compressor 104 of a gas turbine system 102 (FIG. 10), flows into trailing edge cooling circuit 30 via at least one coolant feed 42. Each coolant feed 42 may be formed, for example, using one of trailing edge passages 24 depicted in FIG. 2A or may be provided using any other suitable source of coolant in airfoil 6. At each cooling circuit 32, a portion 44 of flow of coolant 40 passes into outward leg 34 of cooling circuit 32 and flows towards turn 36. Flow of coolant 44 is redirected (e.g., reversed) by turn 36 of cooling circuit 32 and flows into return leg 38 of cooling circuit 32. Portion 44 of flow of coolant 40 passing into each outward leg 34 may be the same for each cooling circuit 32. Alternatively, portion 44 of flow of coolant 40 passing into each outward leg 34 may be different for different sets (i.e., one or more) of cooling circuits 32.

According to embodiments, flows of coolant 44 from a plurality of cooling circuits 32 of trailing edge cooling circuit 30 flow out of return legs 38 of cooling circuits 32 into a collection passage 46. A single collection passage 46 may be provided, however multiple collection passages 46 may also be utilized. Collection passage 46 may be formed, for example, using one of trailing edge passages 24 depicted in FIG. 2A or may be provided using one or more other passages and/or passages within airfoil 6. Although shown as flowing radially outward through collection passage 46 in FIG. 3, the "used" coolant may instead flow radially inward through collection passage 46.

Coolant 48, or a portion thereof, flowing into and through collection passage 46 may be directed (e.g. using one or more passages (e.g., passages 18-24) and/or passages within airfoil 6) to one or more additional cooling circuits of the airfoil and/or blade. To this extent, at least some of the remaining heat capacity of coolant 48 is exploited for cooling purposes instead of being inefficiently expelled from trailing edge 16 of airfoil 6.

Coolant 48, or a portion thereof, may be used to provide film cooling to various areas of airfoil 6 or other parts of the blade. For example, as depicted in FIGS. 1 and 2, coolant 48 may be used to provide cooling film 50 to one or more of pressure side 8, suction side 10, pressure side platform 5, suction side platform 7, and tip area 52 of airfoil 6.

Coolant 48, or a portion thereof, may also be used in a multi-passage (e.g., serpentine) cooling circuit in airfoil 6. For example, coolant 48 may be fed into a serpentine cooling circuit formed by a plurality of pressure side passages 20, a plurality of suction side passages 22, a plurality of the trailing edge passages 24, or combinations thereof. An illustrative serpentine cooling circuit 54 formed using a plurality of trailing edge passages 24 is depicted in FIG. 2A. In serpentine cooling circuit 54, at least a portion of coolant 48 flows in a first radial direction (e.g., out of the page) through a trailing edge passage 24, in an opposite radial direction (e.g., into the page) through another trailing edge passage 24, and in the first radial direction through yet another trailing edge passage 24. Similar serpentine cooling circuits 54 may be formed using pressure side passages 20, suction side passages 22, central passages 26, or combinations thereof.

Coolant 48 may also be used for impingement cooling, or together with cooling pins or fins. For example, in the non-limiting example depicted in FIG. 2A, at least a portion of coolant 48 may be directed to a central passage 26, through an impingement hole 56, and onto a forward surface 58 of a leading edge passage 18 to provide impingement cooling of leading edge 14 of airfoil 6. Other uses of coolant 48 for impingement are also envisioned. At least a portion of coolant 48 may also be directed through a set of cooling pins or fins 60 (e.g., within a passage (e.g., a trailing edge passage 24)). Many other cooling applications employing coolant 48 are also possible.

Figure 7:
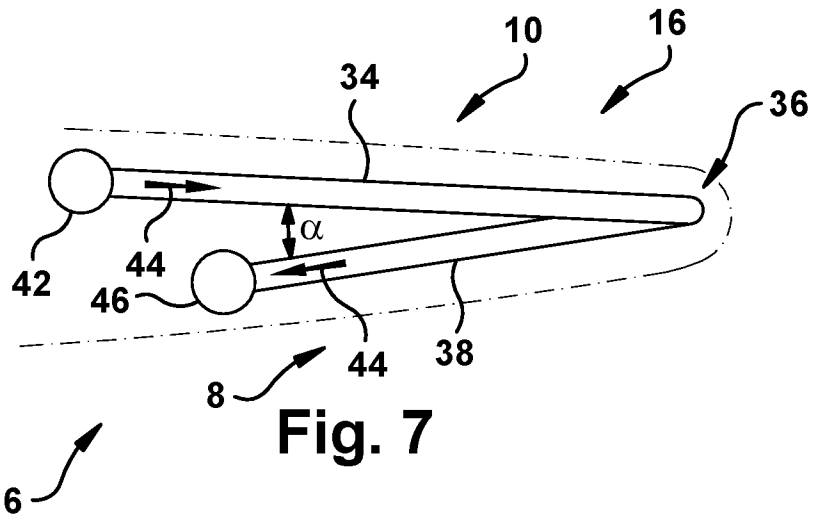
FIG. 7 is top cross-sectional view of the trailing edge cooling circuit of FIG. 6 according to various embodiments.
Figure 6:
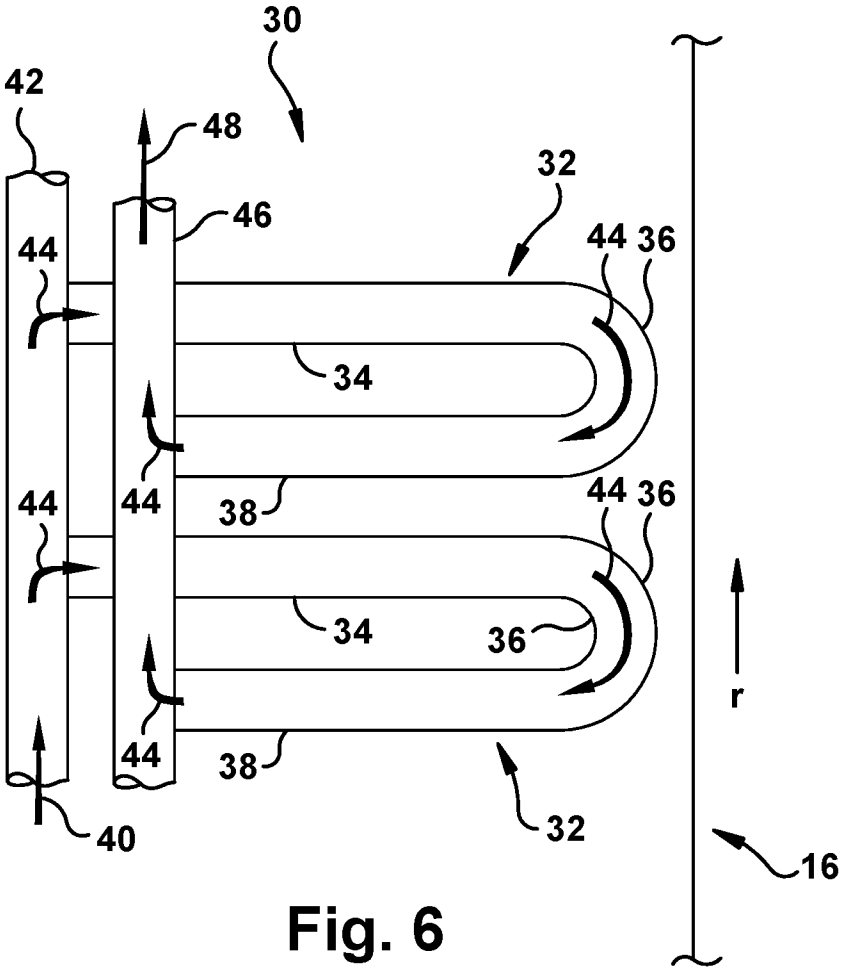
FIG. 6 is a side view of a portion of a trailing edge cooling circuit according to various embodiments.

In embodiments, the legs of one or more of cooling circuits 32 in trailing edge cooling circuit 30 may have different sizes. For example, as depicted in FIGS. 6 and 7, outward leg 34 in each cooling circuit 32 may be larger (e.g., to enhance heat transfer) than that of return leg 38. The size of outward leg 34 may be increased, for example, by increasing at least one of the radial height or the circumferential width of outward leg 34. In other embodiments, outward leg 34 may be smaller than return leg 38.

Figure 8:
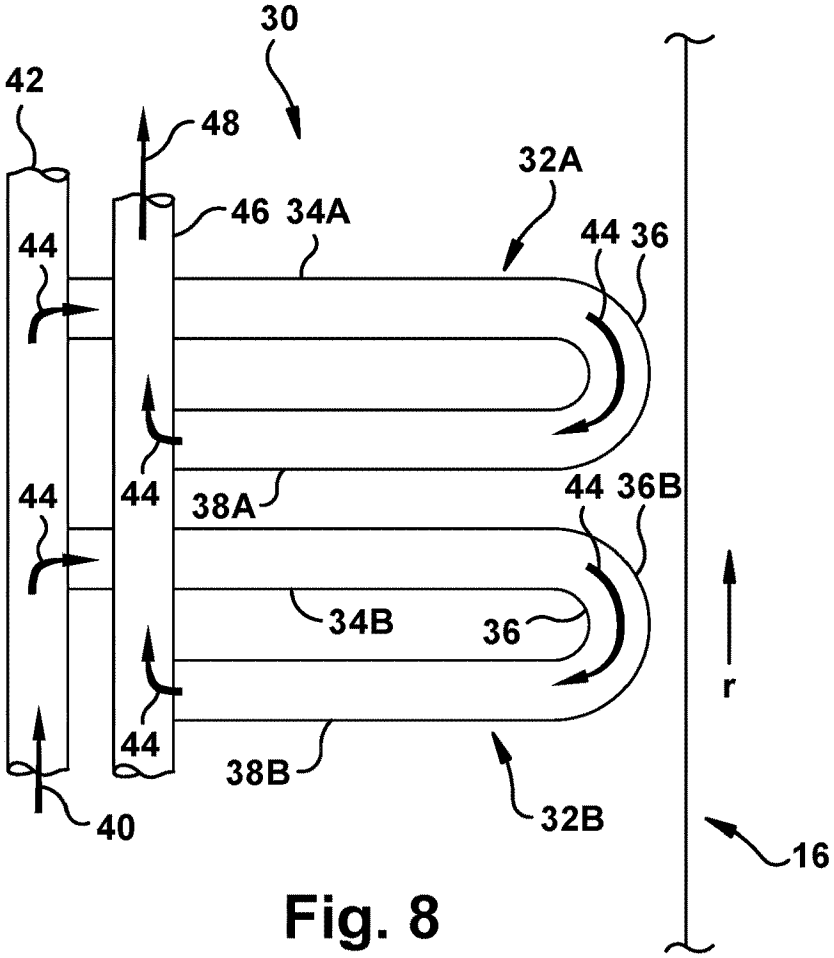
FIG. 8 is a side view of a portion of a trailing edge cooling circuit according to various embodiments.

In further embodiments, the sizes of outward leg 34 and return leg 38 in cooling circuits 32 in trailing edge cooling circuit 30 may vary, for example, based on the relative radial position of cooling circuits 32 within trailing edge 16 of airfoil 6. For example, as depicted in FIG. 8, outward leg 34A and return leg 38A of radially outward cooling circuit 32A may be larger in size (e.g., to enhance heat transfer) than outward leg 34B and return leg 38B, respectively, of cooling circuit 32B.

Figure 9:
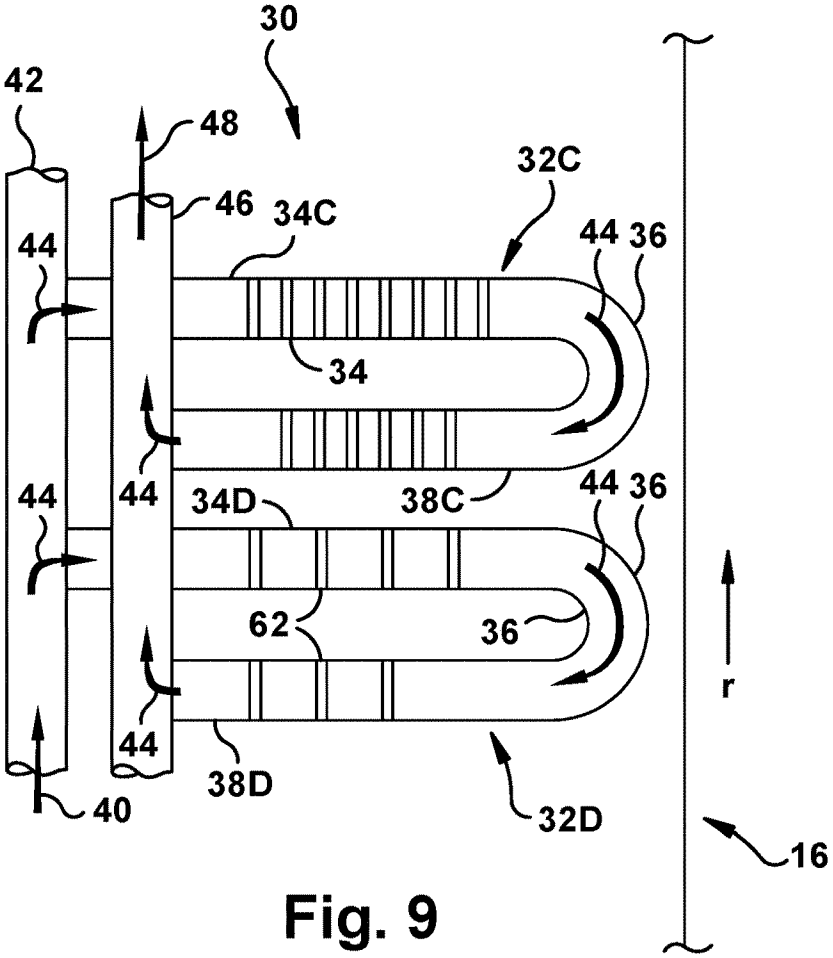
FIG. 9 is a side view of a portion of a trailing edge cooling circuit according to various embodiments.

In additional embodiments, obstructions may be provided within at least one of outward leg 34 or return leg 38 in at least one of cooling circuits 32 in trailing edge cooling circuit 30. The obstructions may include, for example, metal pins, bumps, fins, plugs, and/or the like. Further, the density of the obstructions may vary based on the relative radial position of cooling circuits 32 within airfoil 6. For example, as depicted in FIG. 9, a set of obstructions 62 may be provided in outward leg 34C and return leg 38C of radially outward cooling circuit 32C, and in outward leg 34D and return leg 38D of cooling circuit 32D. The density of obstructions 62 may be higher (e.g., to enhance heat transfer) in outward legs 34C. 34D compared to the density of obstructions 62 in return legs 38C. 38D, respectively. Further, the relative density of obstructions 62 may be higher (e.g., to enhance heat transfer) in radially outward cooling circuit 32C compared to cooling circuit 32D.

Figure 10:
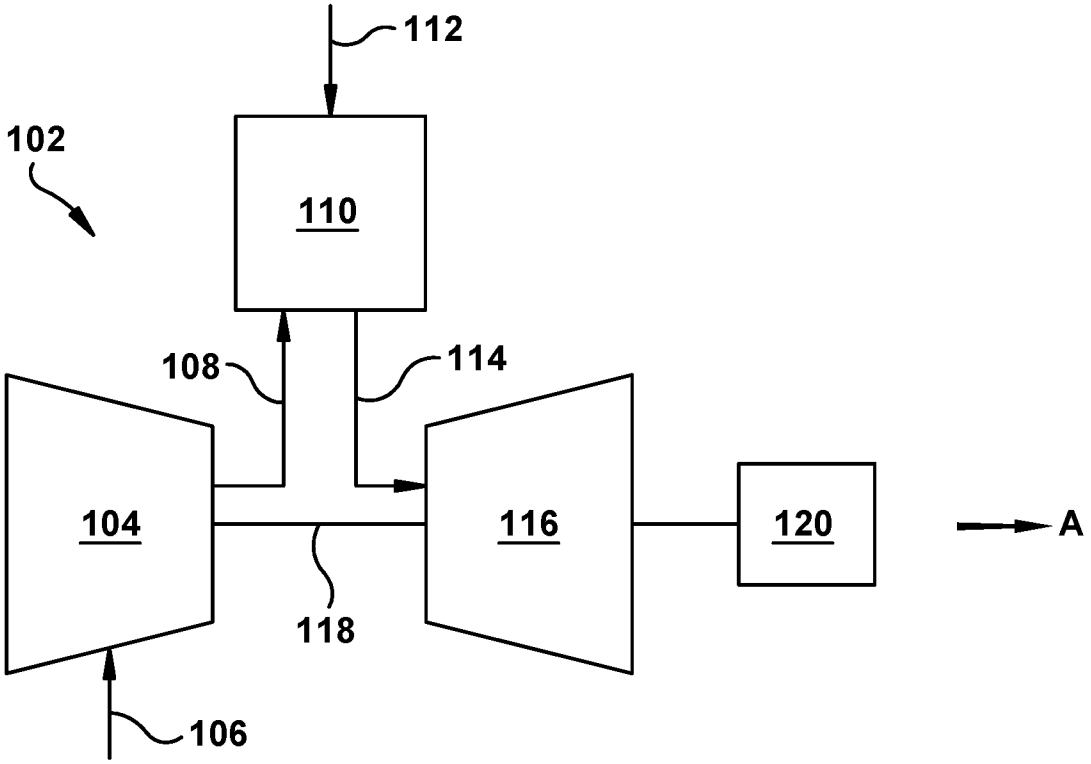
FIG. 10 is a schematic diagram of a gas turbine system according to various embodiments.

FIG. 10 shows a schematic view of gas turbomachine 102 as may be used herein. Gas turbomachine 102 may include a compressor 104. Compressor 104 compresses an incoming flow of air 106. Compressor 104 delivers a flow of compressed air 108 to a combustor 110. Combustor 110 mixes the flow of compressed air 108 with a pressurized flow of fuel 112 and ignites the mixture to create a flow of combustion gases 114. Although only a single combustor 110 is shown, the gas turbine system 102 may include any number of combustors 110. Flow of combustion gases 114 is in turn delivered to a turbine 116, which typically includes a plurality of the turbine blades or nozzles 2 (FIG. 1). Flow of combustion gases 114 drives turbine 116 to produce mechanical work. The mechanical work produced in turbine 116 drives compressor 104 via a shaft 118, and may be used to drive an external load 120, such as an electrical generator and/or the like.

The herein described cooling circuits 32 have been illustrated as applied to a particular airfoil 6. It would be beneficial to provide the advantages of cooling circuits 32 to airfoils that do not already include such circuits. In accordance with another embodiment of the disclosure, shown in FIGS. 11-15, a trailing edge coupon 170 is provided that provides the herein-described cooling circuits for an airfoil of a turbomachine blade or nozzle that does not already include such cooling circuitry. In accordance with yet another embodiment of the disclosure, shown in FIG. 16, a leading edge coupon 370 is provided that provides the herein-described cooling circuits for a leading edge of an airfoil of a turbomachine blade or nozzle that does not already include cooling circuitry.

Figure 11:
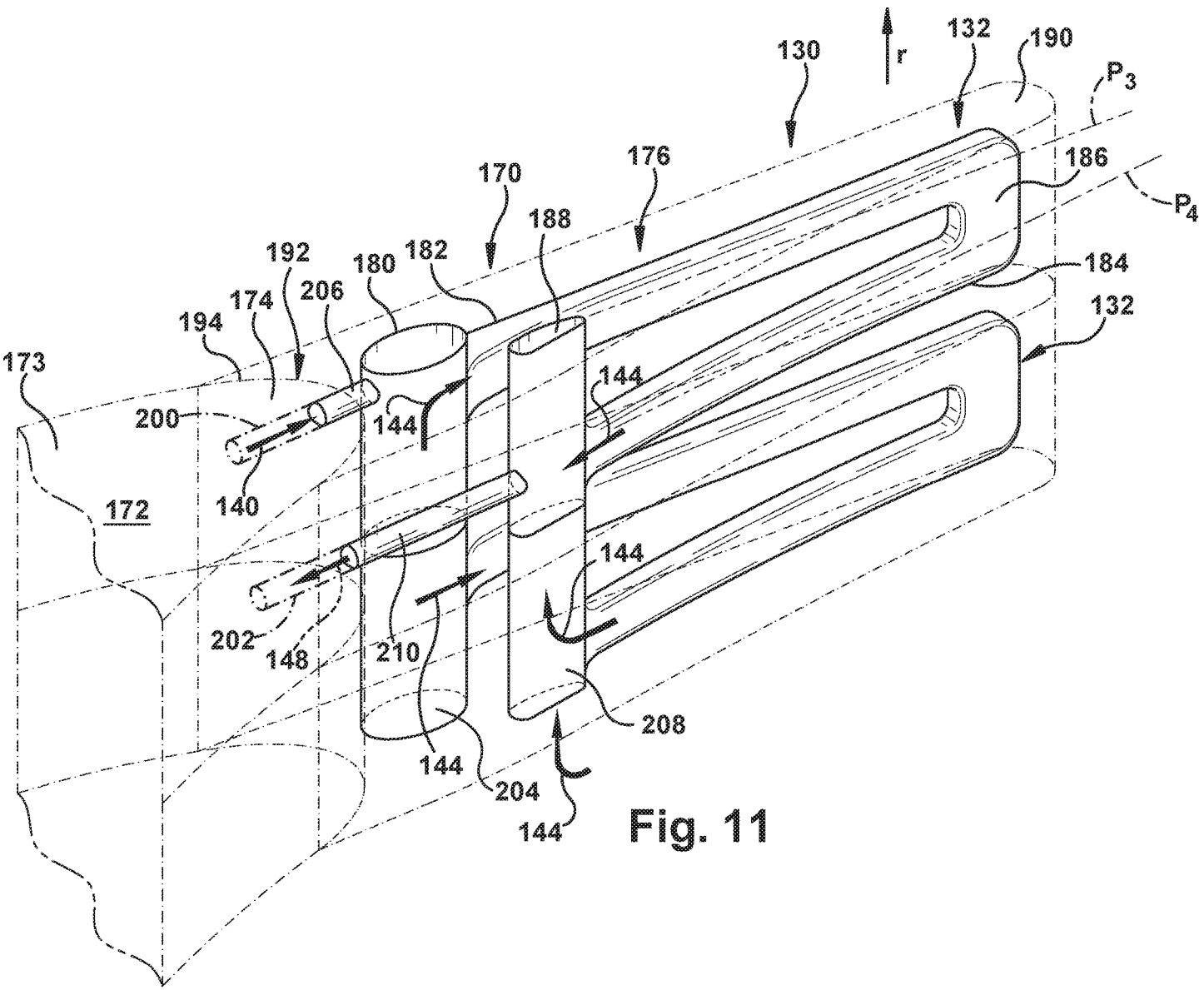
FIG. 11 is a perspective view of a coupon incorporating a cooling circuit according to various embodiments.

FIG. 11 shows a perspective view of a portion of a trailing edge coupon 170 (hereinafter "coupon 170") for an airfoil 172 and positioned against a trailing edge 174 thereof. Coupon 170 provides a trailing edge cooling circuit 130 including one or more radially spaced cooling circuits 132 (two shown), similar to circuits 30 and 32 (FIG. 3) described herein. Airfoil 172 has an airfoil body 173 that is substantially similar to that of airfoil 6 (FIG. 1) described herein, except it does not include cooling circuits 30, 32 (FIG. 3). Further, airfoil 172 may include coolant passages or trailing edge coolant vent holes to cool trailing edge 174, and also configured to accommodate coupon 170, as will be described herein.

FIG. 11 shows coupon 170 may include a coupon body 176. Coupon body 176 may be made of any material capable of coupling with airfoil body 173. In one embodiment, coupon body 176 includes a pre-sintered preform material capable of being brazed to trailing edge 174. Similar to trailing edge circuit 30 (FIG. 3), coupon body 176 may include a coolant feed 180, an outward leg 182, a return leg 184, a turn 186 and a collection passage 188. Outward leg 182 extends toward a trailing edge 190 of coupon 170 (which replaces trailing edge 174) and is fluidly coupled to coolant feed 180. Return leg 184 extends away from trailing edge 190 of coupon 170 and is radially offset from outward leg 182 along a radial axis "r" of coupon 170. Turn 186 fluidly couples outward leg 182 and return leg 184. Collection passage 188 fluidly couples to return leg 184.

In each cooling circuit 132, outward leg 182 is radially offset along the "r" axis relative to return leg 184 by turn 186. To this extent, turn 186 fluidly couples outward leg 182 of cooling circuit 132, which is disposed at a first radial plane $P_3$, to return leg 184 of cooling circuit 132, which is disposed in a second radial plane $P_4$, different from first radial plane $P_3$. In the non-limiting embodiment shown in FIG. 11, for example, outward leg 182 is positioned radially outward relative to return leg 184 in each of cooling circuits 132. In other embodiments, in one or more of cooling circuits 132, the radial positioning of outward leg 182 relative to return leg 184 may be reversed such that outward leg 182 is positioned radially inward relative to return leg 184. That is, the radial offset of outward leg 182 from return leg 184 may be either: radially outward from return leg 184 or radially inward from return leg 184.

Figure 12:
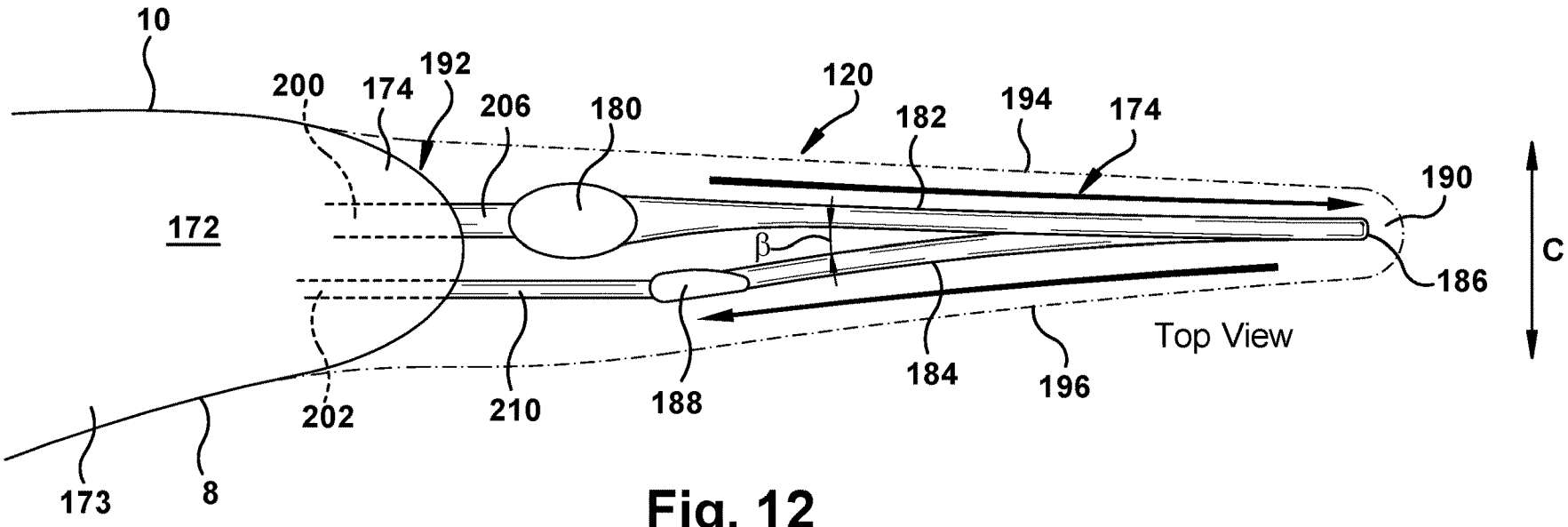
FIG. 12 is top view of a coupon incorporating a cooling circuit according to various embodiments.

As shown in FIG. 12, in addition to a radial offset, outward leg 182 may be circumferentially offset by turn 186 at an angle β relative to return leg 184. In this configuration, outward leg 182 extends along suction side 194 of coupon in line with suction side 10 of airfoil 172, while return leg 184 extends along pressure side 196 of coupon 170 in line with pressure side 8 of airfoil 172. Each leg 182, 184 may follow the outer contours of their respective adjacent side 194 or 196 of coupon 170. The radial and circumferential offsets may vary, for example, based on geometric and heat capacity constraints on trailing edge cooling circuit 130 and/or other factors. In other embodiments, outward leg 182 may extend along pressure side 196 of coupon 170, while return leg 184 may extend along suction side 194 of coupon 170. Each leg 182, 184 may follow the outer contours of their respective adjacent side 194 or 196 of coupon 170.

In further embodiments, as described herein relative to similar embodiments of airfoil 6 in FIGS. 6-8, the sizes of outward leg 182 and return leg 184 in one or more cooling circuits 132 in trailing edge cooling circuit 130 of coupon 170 may vary, for example, based on the relative radial position of cooling circuits 132 within trailing edge 190 of coupon 170 and/or airfoil 172. See previous description of legs 34, 38 relative to FIGS. 6-8. In additional embodiments, as described relative to FIG. 9, obstructions may be provided within at least one of outward leg 182 or return leg 184 in at least one of cooling circuits 132 in trailing edge cooling circuit 130 of coupon 170. The obstructions may take any form described herein. Further, per the description of FIG. 9, the density of the obstructions may vary based on the relative radial position of cooling circuits 132 within coupon 170 and/or airfoil 172.

Figure 13:
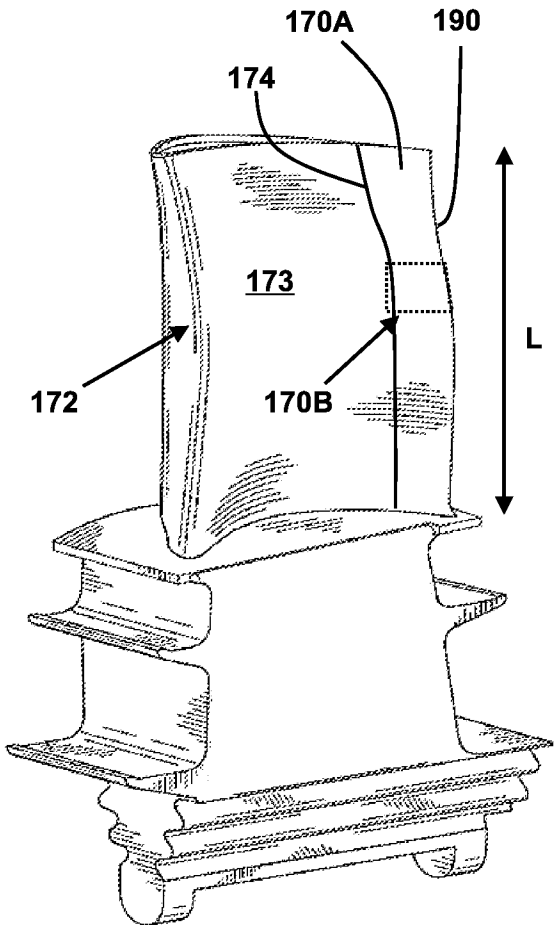
FIG. 13 is a perspective view depicting positioning of a coupon according to various embodiments.

A non-limiting position of coupon 170 (with trailing edge cooling circuit 130 depicted in FIG. 11) within airfoil 172 is illustrated in FIG. 13. As shown in FIG. 13, in embodiments, a coupon 170A and trailing edge cooling circuit therein may extend along the entire radial length L of trailing edge 174 of airfoil 172. In other embodiments, as shown in phantom in FIG. 13, a coupon 170B (and trailing edge cooling circuit 130 therein) may partially extend along one or more portions of trailing edge 174 of airfoil 172.

Figure 14:
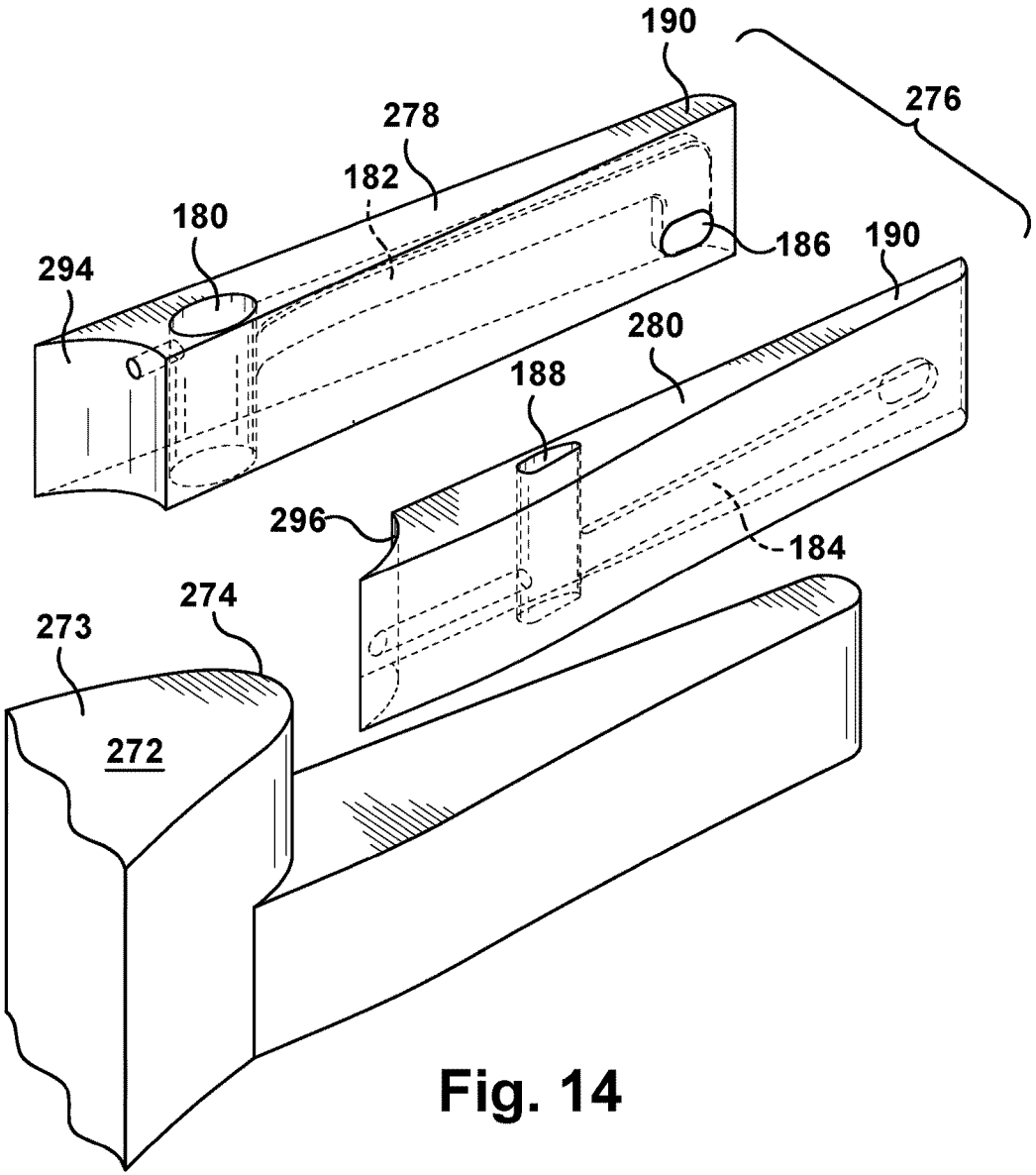
FIG. 14 is a perspective view of a coupon incorporating a sectioned coupon according to various embodiments.

Returning to FIG. 11, coupon 170 also includes a coupling region 192 configured to mate with airfoil body 173 of airfoil 172, e.g., trailing edge 174 thereof. Coupling region 192 may include any surface shape, dimension, etc., allowing for coupling of coupon 170 to airfoil body 173. In one non-limiting embodiment shown in FIG. 11, coupling region 192 includes a curved surface 194 shaped and sized to mate with trailing edge 174 of airfoil 172 in such a way that coupon 170 can be brazed to airfoil 172. That is, coupling region 192 is positioned at a forward end of coupon 170, and couples to trailing edge 174 of airfoil body 173 of airfoil 172. In one alternative embodiment, as shown in FIG. 14, a coupon 270 includes a coupon body 276 having a first section 278 and a separate, second section 280 that collectively form the coupon body. Each section 278, 280 may include a portion of a respective trailing edge cooling circuit 132. In the example shown, first section 278 includes coolant feed 180 and outward leg 182, and second section 280 includes collection passage 188, return leg 184 and turn 186. Turn 186 in second portion 280 is configured to fluidly mate with outward leg 182 in first section 278. It is understood that various alternative passage configurations are possible in a sectioned coupon. In any event, first section 278 and second section 280 are brazed together, and coupon 270 is brazed to airfoil body 273 of airfoil 272. A coupling region of coupon 270 may include mating curved surfaces 294, 296 that mate with a trailing edge 274 of an airfoil 272.

Figure 15:
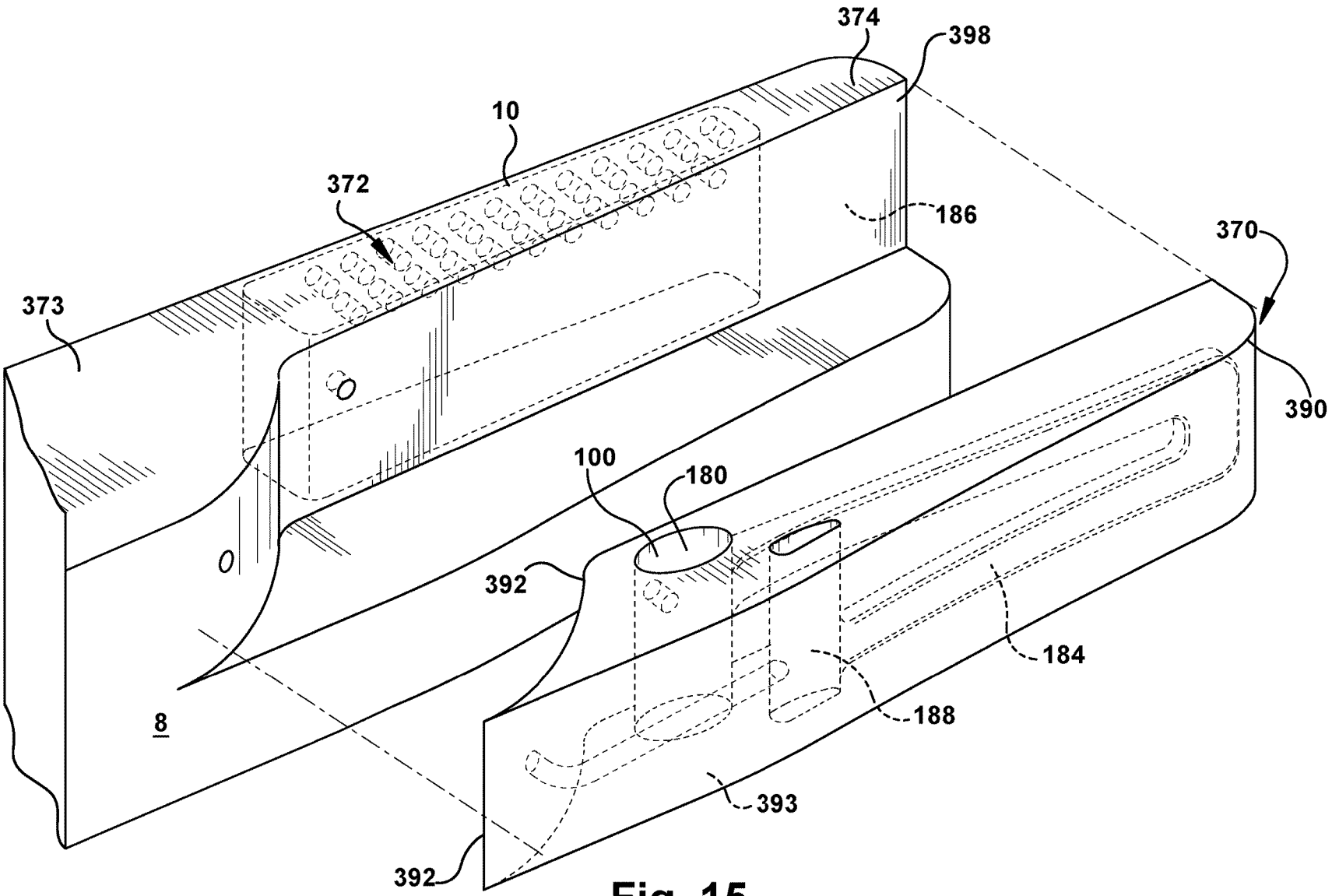
FIG. 15 is a perspective view of a coupon incorporating a side mounted coupon according to various embodiments.

In another non-limiting embodiment shown in FIG. 15, a coupon 370 may be configured to mate with a side 398 of an airfoil 372. In this case, a coupling region 392 is positioned at a side of coupon 370, and couples to a seat 393 in one of a pressure side 8 (shown) and a suction side 10 of an airfoil body 373. Airfoil body 373 and coupon 370 have mating passages to allow for coolant flow to coupon 370.

Operation of a coupon according to the various embodiments will now be described with reference to the FIG. 11 embodiment. In operation, when the coupon is coupled to the airfoil, coolant feed 180 is configured to fluidly couple to a coolant feed 200 in airfoil body 173 of airfoil 172, and collection passage 188 is configured to fluidly couple to a coolant passage 202 in airfoil body 173 of airfoil 172. Coolant feed 200 may include any form of passage within airfoil body 173 capable of delivering coolant to coolant feed 180. In one embodiment, coolant feed 200 in airfoil body 172 may include one or more trailing edge exit holes within trailing edge 174. However, a variety of alternative coolant feeds 200 are possible. Coolant feed 180 may include a radially extending passage 204 capable of coupling to a number of radially spaced outward legs 182, and may include, where necessary, any form of connection passage 206 to fluidly couple with coolant feed 202 in airfoil body 173. Collection passage 188 may similarly include a radially extending passage 208 capable of coupling to a number of radially spaced return legs 184, and may include, where necessary, any form of connection passage 210 to fluidly couple with coolant passage 202 in airfoil body 173. Coolant feed 200 and coolant passage 202 may couple to any of the herein described coolant passages 22, 24, 26 (FIG. 2A). In FIG. 11, coolant feed 180 and collection passage 188 are positioned circumferentially side-by-side, e.g., within the same radial plane. As shown in a top view in FIG. 12, in an alternative embodiment, coolant feed 180 and collection passage 188 may be axially spaced.

A flow of coolant 140, for example, air generated by a compressor 104 of a gas turbine system 102 (FIG. 10), flows into trailing edge cooling circuit 130 of coupon 170 via at least one coolant feed 180. Each coolant feed 180 may be fluidly coupled to a source of coolant, for example, using one of trailing edge passages 24 depicted in FIG. 2A or may be provided using any other suitable source of coolant in airfoil 172. At each cooling circuit 132, a portion 144 of flow of coolant 140 passes into outward leg 182 of cooling circuit 132 and flows towards turn 186. Flow of coolant 144 is redirected (e.g., reversed) by turn 186 of cooling circuit 132 and flows into return leg 184 of cooling circuit 132. As described herein relative to FIG. 3, portion 144 of flow of coolant 140 passing into each outward leg 182 may be the same for each cooling circuit 132. Alternatively, portion 144 of flow of coolant 140 passing into each outward leg 182 may be different for different sets (i.e., one or more) of cooling circuits 132.

According to embodiments, flows of coolant 144 from a plurality of the cooling circuits 132 of trailing edge cooling circuit 130 flow out of return legs 184 of cooling circuits 132 into a collection passage 188. A single collection passage 188 may be provided, however multiple collection passages 188 may also be utilized. Collection passage 188 may be formed in coupon 170, and may fluidly couple, via connection passage 210 to, for example, one of trailing edge passages 24 depicted in FIG. 2A or may be provided using one or more other passages and/or passages within airfoil 172 (similar to airfoil 6 in FIG. 2A). Although shown as flowing radially outward through collection passage 188 in FIG. 11, the "used" coolant may instead flow radially inward through collection passage 188.

Coolant 148, or a portion thereof, flowing into and through collection passage 188 may be directed (e.g. using one or more passages (e.g., passages 18-24 in FIG. 2A) and/or passages within airfoil 172) to one or more additional cooling circuits of the airfoil and/or blade, as previously described herein. To this extent, at least some of the remaining heat capacity of coolant 148 is exploited for cooling purposes instead of being inefficiently expelled from trailing edge 174 of airfoil 172, even though airfoil 172 did not originally include trailing edge circuit 130.

As described herein, coolant 148, or a portion thereof, may be used to provide film cooling to various areas of airfoil 172 or other parts of the blade 2. For example, as depicted in FIGS. 1 and 2, coolant 148 may be used to provide cooling film 50 to one or more of pressure side 8, suction side 10, pressure side platform 5, suction side platform 7, and tip area 52 of airfoil 172.

As also described herein, coolant 148, or a portion thereof, may also be used in a multi-passage (e.g., serpentine) cooling circuit in airfoil 172. For example, coolant 148 may be fed into a serpentine cooling circuit formed by a plurality of pressure side passages 20, a plurality of suction side passages 22, a plurality of the trailing edge passages 24, or combinations thereof. An illustrative serpentine cooling circuit 54 formed using a plurality of trailing edge passages 24 is depicted in FIG. 2A. In serpentine cooling circuit 54, at least a portion of coolant 148 flows in a first radial direction (e.g., out of the page) through a trailing edge passage 24, in an opposite radial direction (e.g., into the page) through another trailing edge passage 24, and in the first radial direction through yet another trailing edge passage 24. Similar serpentine cooling circuits 54 may be formed using pressure side passages 20, suction side passages 22, central passages 26, or combinations thereof.

Further, as described herein, coolant 148 may also be used for impingement cooling, or together with cooling pins or fins. For example, in the non-limiting example depicted in FIG. 2A, at least a portion of coolant 148 may be directed to a central passage 26, through an impingement hole 56, and onto a forward surface 58 of a leading edge passage 18 to provide impingement cooling of leading edge 14 of airfoil 6. Other uses of coolant 148 for impingement are also envisioned. At least a portion of coolant 148 may also be directed through a set of cooling pins or fins 60 (e.g., within a passage (e.g., a trailing edge passage 24)). Many other cooling applications employing coolant 48 are also possible.

Figure 16:
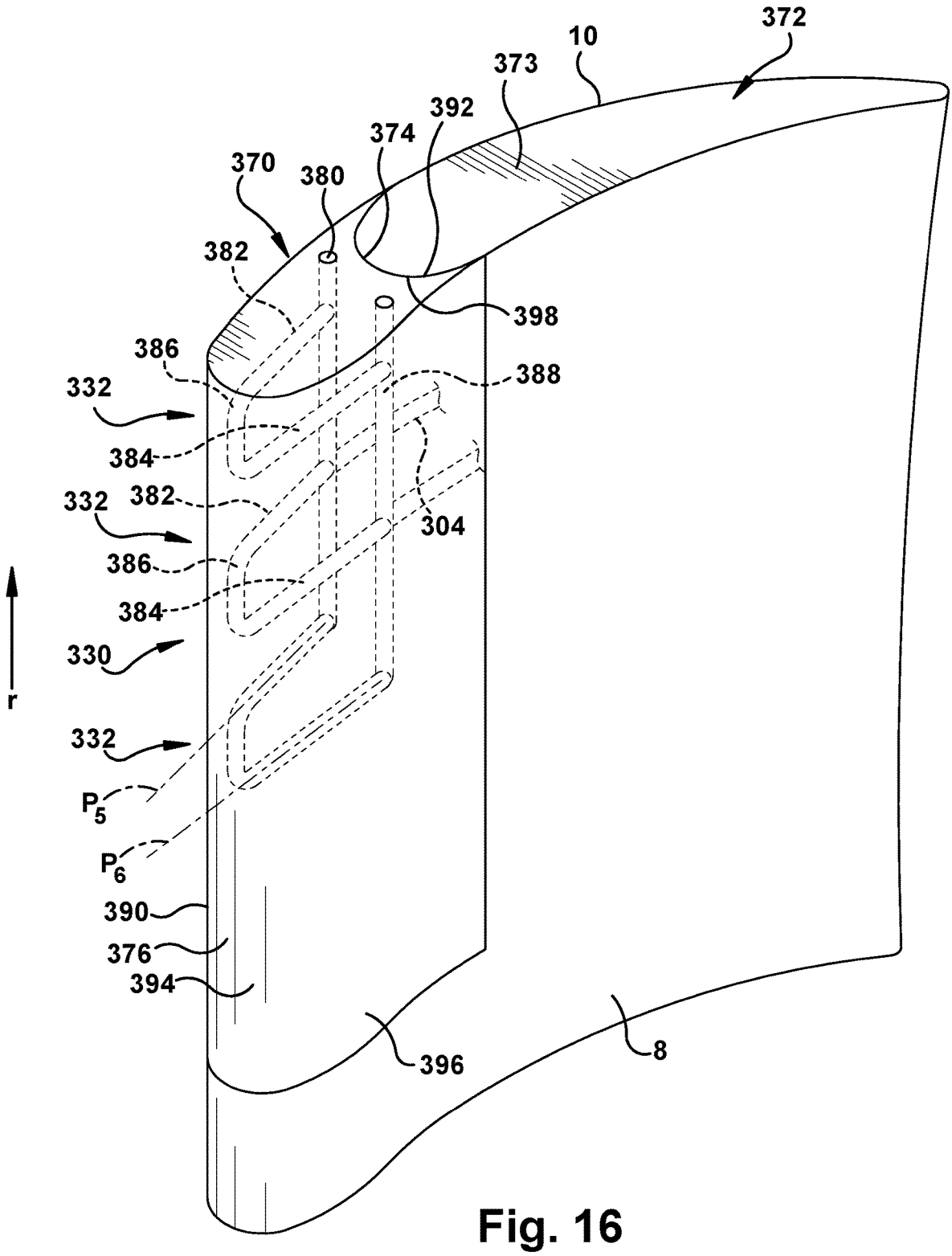
FIG. 16 is a perspective view of a leading edge coupon according to various embodiments.

FIG. 16 shows a perspective view of a portion of a leading edge coupon 370 (hereinafter "coupon 370") for an airfoil 373 and positioned against a leading edge 374 thereof. Coupon 370 provides a leading edge cooling circuit 330 including one or more radially spaced cooling circuits 333 (three shown), similar to circuits 30 and 32 (FIG. 3) and cooling circuit 130 (FIG. 11), and described herein. Airfoil 373 has an airfoil body 373 that is substantially similar to that of airfoil 6 (FIG. 1) described herein, except it does not include cooling circuits in a leading edge thereof. Further, airfoil 372 may include coolant passages (e.g., at least one pressure side (near wall) passage 20, or at least one suction side (near wall) passage 22 (FIG. 2A)), or leading edge coolant vent holes (not shown) to cool leading edge 374, and also configured to accommodate coupon 370, as will be described herein.

FIG. 16 shows coupon 370 may include a coupon body 376. Coupon body 376 may be made of any material capable of coupling with airfoil body 373. In one embodiment, coupon body 376 includes a pre-sintered preform material capable of being brazed to trailing edge 374. Similar to trailing edge circuit 30 (FIG. 3) and coupon 170 (FIG. 11), coupon body 376 may include a coolant feed 380, an outward leg 382, a return leg 384, a turn 386 and a collection passage 388. Outward leg 382 extends toward a leading edge 390 of coupon 370 (which replaces leading edge 374) and is fluidly coupled to coolant feed 380. Return leg 384 extends away from leading edge 390 of coupon 370 and is radially offset from outward leg 382 along a radial axis "r" of coupon 370. Turn 386 fluidly couples outward leg 382 and return leg 384. Collection passage 388 fluidly couples to return leg 384.

In each cooling circuit 332, outward leg 382 is radially offset along the "r" axis relative to return leg 384 by turn 386. To this extent, turn 386 fluidly couples outward leg 382 of cooling circuit 332, which is disposed at a first radial plane $P_5$, to return leg 384 of cooling circuit 332, which is disposed in a second radial plane $P_6$, different from first radial plane $P_5$. In the non-limiting embodiment shown in FIG. 16, for example, outward leg 382 is positioned radially outward relative to return leg 384 in each of cooling circuits 332. In other embodiments, in one or more of cooling circuits 332, the radial positioning of outward leg 382 relative to return leg 384 may be reversed such that outward leg 382 is positioned radially inward relative to return leg 384. That is, the radial offset of outward leg 382 from return leg 384 may be either: radially outward from return leg 384 or radially inward from return leg 384.

A radial offset may also be provided such that outward leg 382 may be circumferentially offset by turn 386 at an angle (β in FIG. 12) relative to return leg 384, as described relative to FIG. 12. In this configuration, outward leg 382 extends along suction side 394 of coupon in line with suction side 10 of airfoil 372, while return leg 384 extends along pressure side 396 of coupon 370 in line with pressure side 8 of airfoil 372. Each leg 382, 384 may follow the outer contours of their respective adjacent side 394 or 396 of coupon 370. The radial and circumferential offsets may vary, for example, based on geometric and heat capacity constraints on trailing edge cooling circuit 330 and/or other factors. In other embodiments, outward leg 382 may extend along pressure side 396 of coupon 370, while return leg 386 may extend along suction side 394 of coupon 370. Each leg 382, 384 may follow the outer contours of their respective adjacent side 394 or 396 of coupon 370.

In further embodiments, as described herein relative to similar embodiments of airfoil 6 in FIGS. 6-8, the sizes of outward leg 382 and return leg 384 in one or more cooling circuits 332 in trailing edge cooling circuit 330 of coupon 370 may vary, for example, based on the relative radial position of cooling circuits 332 within trailing edge 390 of coupon 370 and/or airfoil 372. See previous description of legs 34, 38 relative to FIGS. 6-8. In additional embodiments, as described relative to FIG. 9, obstructions may be provided within at least one of outward leg 382 or return leg 384 in at least one of cooling circuits 332 in trailing edge cooling circuit 330 of coupon 370. The obstructions may take any form described herein. Further, per the description of FIG. 9, the density of the obstructions may vary based on the relative radial position of cooling circuits 332 within coupon 370 and/or airfoil 372.

As described herein relative to coupon 170, coupon 370 may extend along the entire radial length L of leading edge 374 of airfoil 372, or may partially extend along one or more portions of leading edge 374 of airfoil 372.

Returning to FIG. 16, coupon 370 also includes a coupling region 392 configured to mate with airfoil body 373 of airfoil 372, e.g., leading edge 374 thereof. Coupling region 392 may include any surface shape, dimension, etc., allowing for coupling of coupon 370 to airfoil body 373. In one non-limiting embodiment shown in FIG. 16, coupling region 392 includes a curved surface 398 shaped and sized to mate with leading edge 374 of airfoil 372 in such a way that coupon 370 can be brazed to airfoil 372. That is, coupling region 392 is positioned at a rear end of coupon 370, and couples to leading edge 374 of airfoil body 373 of airfoil 372. Coupon 370 may be sectioned similar to coupon 170. Each section may include a portion of a respective leading edge cooling circuit 332. It is understood that various alternative passage configurations are possible in a sectioned coupon. In another non-limiting embodiment, coupon 370 may be configured to mate with a side of airfoil 372 similar to that described in FIG. 15. In this case, a coupling region 392 is positioned at a side of coupon 370, and couples to a seat in one of a pressure side 8 (shown) and a suction side 10 of an airfoil body 373. Airfoil body 373 and coupon 370 have mating passages to allow for coolant flow to coupon 370.

To provide additional cooling of the trailing edge of multi-wall airfoil/blade and/or to provide cooling film directly to the trailing edge, exhaust passages (not shown) may pass from any part of any of the cooling circuit(s) described herein through the trailing edge and out of the trailing edge and/or out of a side of the airfoil/blade adjacent to the trailing edge. Each exhaust passage(s) may be sized and/or positioned within the trailing edge to receive only a portion (e.g., less than half) of the coolant flowing in particular cooling circuit(s). Even with the inclusion of the exhaust passages(s), the majority (e.g., more than half) of the coolant may still flow through the cooling circuit(s), and specifically the return leg thereof, to subsequently be provided to distinct portions of multi-wall airfoil/blade for other purposes as described herein, e.g., film and/or impingement cooling.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding). As used herein, "fluidly coupled" or "fluidly mating" indicates passages or other structure allowing a fluid to pass therebetween.

When an element or layer is referred to as being "on", "engaged to", "connected to" or "coupled to" another element, it may be directly on, engaged, connected or coupled to the other element, or intervening elements may be present. In contrast, when an element is referred to as being "directly on," "directly engaged to", "directly connected to" or "directly coupled to" another element, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A trailing edge coupon for a turbomachine airfoil, the coupon comprising:

a coupon body including:

a coolant feed extending radially through the coupon body;

a collection passage extending radially through the coupon body, adjacent the coolant feed;

an outward leg conduit extending axially from the coolant feed, toward a trailing edge of the coupon, the outward leg conduit in direct fluid communication with the coolant feed;

a return leg conduit extending axially away from the trailing edge of the coupon, toward the collection passage, and radially offset from the outward leg conduit along a radial axis of the coupon, the return leg conduit in direct fluid communication with the collection passage;

a turn conduit fluidly coupling the outward leg conduit and the return leg conduit, the turn conduit positioned adjacent the trailing edge of the coupon; and a coupling region configured to mate with an airfoil body of the turbomachine airfoil.

2. The trailing edge coupon of claim 1, wherein the coupon includes at least one pre-sintered preform material.

3. The trailing edge coupon of claim 1, wherein the coolant feed is configured to fluidly couple to a coolant feed in the airfoil body of the turbomachine airfoil, and the collection passage is configured to fluidly couple to a coolant passage in the airfoil body of the turbomachine airfoil.

4. The trailing edge coupon of claim 1, wherein the coupling region is positioned at a forward end of the coupon, and couples to a trailing edge of the airfoil body of the turbomachine airfoil.

5. The trailing edge coupon of claim 1, wherein the coupling region is positioned at a side of the coupon, and couples to one of a pressure side and a suction side of the airfoil body of the turbomachine airfoil.

6. The trailing edge coupon of claim 1, wherein the coupon body includes a first section and a second section that collectively form the coupon body.

7. The trailing edge coupon of claim 6, wherein the first section and second section are brazed together, and the coupon is brazed to the airfoil body of the turbomachine airfoil.

8. The trailing edge coupon of claim 1, wherein the radial offset of the outward leg conduit from the return leg conduit is selected from the group consisting of: radially outward from the return leg conduit and radially inward from the return leg conduit.

9. The trailing edge coupon claim 1, wherein the return leg conduit is a different size as compared to the outward leg conduit.

10. The trailing edge coupon of claim 1, wherein the return leg conduit is circumferentially offset relative to the outward leg conduit.

11. The trailing edge coupon of claim 10, wherein the circumferential offset is selected from the group consisting of the outward leg conduit extending along a suction side of the airfoil body and the return leg conduit extending along a pressure side of the airfoil body, and the outward leg conduit extending along the pressure side of the airfoil body and the return leg conduit extending along the suction side of the airfoil body.

12. A turbomachine airfoil, comprising:

an airfoil body; and a coupon having a coupon body including:

a coolant feed extending radially through the coupon body;

a collection passage extending radially through the coupon body, adjacent the coolant feed;

an outward leg conduit extending axially from the coolant feed, toward a trailing edge of the coupon, the outward leg conduit in direct fluid communication with the coolant feed;

a return leg conduit extending axially away from the trailing edge of the coupon, toward the collection passage, and radially offset from the outward leg conduit along a radial axis of the coupon, the return leg conduit in direct fluid communication with the collection passage;

a turn conduit fluidly coupling the outward leg conduit and the return leg conduit, the turn conduit positioned adjacent the trailing edge of the coupon; and a coupling region configured to mate with the airfoil body.

13. The turbomachine airfoil of claim 12, wherein the coupon includes at least one pre-sintered preform material.

14. The turbomachine airfoil of claim 12, wherein the coolant feed is configured to fluidly couple to a coolant feed in the airfoil body, and the collection passage is configured to fluidly couple to a coolant passage in the airfoil body.

15. The turbomachine airfoil of claim 12, wherein the coupling region is positioned at a forward end of the coupon, and couples to a trailing edge of the airfoil body.

16. The turbomachine airfoil of claim 12, wherein the coupling region is positioned at a side of the coupon, and couples to one of a pressure side and a suction side of the airfoil body.

17. The turbomachine airfoil of claim 12, wherein the coupon body includes a first section and a second section that collectively form the coupon body, and wherein the first section and second section are brazed together, and the coupon is brazed to the airfoil body.

18. The turbomachine airfoil of claim 12, further comprising a flow of coolant passing through the coolant feed, the outward leg conduit, the turn conduit and the return leg conduit, and into the collection passage, and from the collection passage to at least one cooling circuit of the airfoil body of the airfoil.

19. The turbomachine airfoil of claim 18, wherein the at least one cooling circuit provides at least one of film cooling, convection cooling, or impingement cooling.

20. A turbine system, comprising:

a gas turbine system including a compressor component, a combustor component, and a turbine component, the turbine component including a plurality of turbine blades, at least one of the plurality of turbine blades including a turbine blade including an airfoil body; and a coupon coupled to a trailing edge of the airfoil body of the turbine blade, the coupon having a coupon body including:

a coolant feed extending radially through the coupon body, a collection passage extending radially through the coupon body, adjacent the coolant feed, an outward leg conduit extending axially from the coolant feed, toward a trailing edge of the coupon, the outward leg conduit in direct fluid communication with the coolant feed, a return leg conduit extending axially away from the trailing edge of the coupon, toward the collection passage, and radially offset from the outward leg conduit along a radial axis of the coupon, the return leg conduit in direct fluid communication with the collection passage, a turn conduit for fluidly coupling the outward leg conduit and the return leg conduit, the turn conduit positioned adjacent the trailing edge of the coupon, a coupling region configured to mate with the airfoil body of the at least one turbine blade of the plurality of turbine blades.

21. An edge coupon for a turbomachine airfoil, the coupon comprising:

a coupon body including:

a coolant feed extending radially through the coupon body;

a collection passage extending radially through the coupon body, adjacent the coolant feed;

an outward leg conduit extending axially from the coolant feed, toward an edge of the coupon, the outward leg conduit in direct fluid communication with the coolant feed;

a return leg conduit extending axially away from the edge of the coupon, toward the collection passage, and radially offset from the outward leg conduit along a radial axis of the coupon, the return leg conduit in direct fluid communication with the collection passage;

a turn conduit fluidly coupling the outward leg conduit and the return leg conduit, the turn conduit positioned adjacent the edge of the coupon; and a coupling region configured to mate with an airfoil body of the turbomachine airfoil.

* * * * *